United States Patent [19]

LaRue

[11] Patent Number: 4,572,577

[45] Date of Patent: Feb. 25, 1986

[54] PORTABLE SEAT HAVING SLIDABLE LEG-SUPPORTING SECTIONS FOR LEG AMPUTEES

[76] Inventor: Adrian J. LaRue, 300 Beechwood La., Elizabethtown, Pa. 17022

[21] Appl. No.: 639,844

[22] Filed: Aug. 13, 1984

[51] Int. Cl.[4] ..... A47C 7/50

[52] U.S. Cl. ..... 297/430; 297/438; 297/DIG. 4

[58] Field of Search ..... 297/430, 429, 423, DIG. 4, 297/431, 438; 5/443, 444

[56] References Cited

U.S. PATENT DOCUMENTS

| | | | |
|---|---|---|---|
| 161,887 | 4/1875 | Lambert | 297/430 |
| 2,247,720 | 7/1941 | Wonderly | 297/430 X |
| 2,317,894 | 4/1943 | Doty | 297/253 |
| 2,516,557 | 7/1950 | Frazee et al. | 297/250 X |
| 2,609,864 | 9/1952 | Gates, Jr. | 297/430 X |
| 3,565,485 | 2/1971 | Eisenhauer | 297/438 |
| 3,861,745 | 1/1975 | Forest | 297/429 X |
| 3,865,427 | 2/1975 | Delany | 297/DIG. 4 |

*Primary Examiner*—James T. McCall

*Attorney, Agent, or Firm*—Adrian J. La Rue

[57] ABSTRACT

A portable seat for disposition in a chair comprises a seat section on which a leg amputee sits and slidable leg-supporting sections on which a residual limb is supported when the leg-supporting section is moved from a nonleg-supporting position within the seat section to a leg-supporting position in a substantially horizontal position. The leg-supporting section can be slidable within the seat section when the amputee wishes to rise to a standing position.

9 Claims, 5 Drawing Figures

PORTABLE SEAT HAVING SLIDABLE LEG-SUPPORTING SECTIONS FOR LEG AMPUTEES

FIELD OF THE INVENTION

This invention relates to a seat for persons having an amputated leg and more particularly to a portable seat that can be placed upon any type of chair including a wheel chair and includes a seat section and slidable leg-supporting sections that can be slidably moved to a leg-supporting position or to an out of the way position within the seat section.

BACKGROUND OF THE INVENTION

U.S. Pat. No. 3,861,745 discloses a portable seat that can be placed upon a wheel chair or any type of chair upon which a person with an amputated leg can sit. The portable seat is provided with a section that is mounted to the seat by a hinge arrangement so that the hinged section can be moved to a leg-supporting position from a nonleg-supporting position and another hinge is operated to maintain the hinged section in the leg-supporting position. This enables the person with an amputated leg to horizontally support the residual limb on the hinged section while sitting on the portable seat to insure proper circulation and knee extension. When the person wants to rise to a standing position, the hinge is operated to move the hinged section to a downward nonleg-supporting position so that the person can now arise from the seat because the hinge section is now out of the way.

While this portable seat is useful to support the residual limb, the seat is bulky because of the hinged section, and the hinged section generally has to be operated by another person. The hinge structure not only includes hinges to hingedly mount the hinged section to the seat, but also another hinge that is locked into one position to maintain the hinged section in a leg-supporting position and a release mechanism is included with the other hinge to unlock it so that the hinged section can be moved to a nonleg-supporting position. This constitutes a complex and expensive portable seat for use by leg amputees.

SUMMARY OF THE INVENTION

According to the present invention, a portable seat for leg amputees that can be positioned on any support such as a chair to provide a support on which the leg amputee is supported but also a support in which the residual limb is supported, comprises a seat section on which the amputee sits and a leg-supporting section slidably mounted in the seat section that can be slidably moved out from the seat section to a leg-supporting position or slidably moved into the seat section to an out of the way position. The portable seat is nonbulky of simple construction and can be operated by the leg amputee.

BRIEF DESCRIPTION OF THE DRAWINGS

FIG. (1) is a perspective view of a wheel chair in the seat of which is disposed a portable seat with a leg-supporting section thereof in a leg-supporting position while the other leg-supporting section is in a nonleg-supporting position.

FIG. (2) is an exploded perspective view of the components of the portable seat.

FIG. (3) is a top plan view of the portable seat in an assembled condition with the top member removed and one of the leg-supporting sections in a leg-supporting position.

Figure 3:
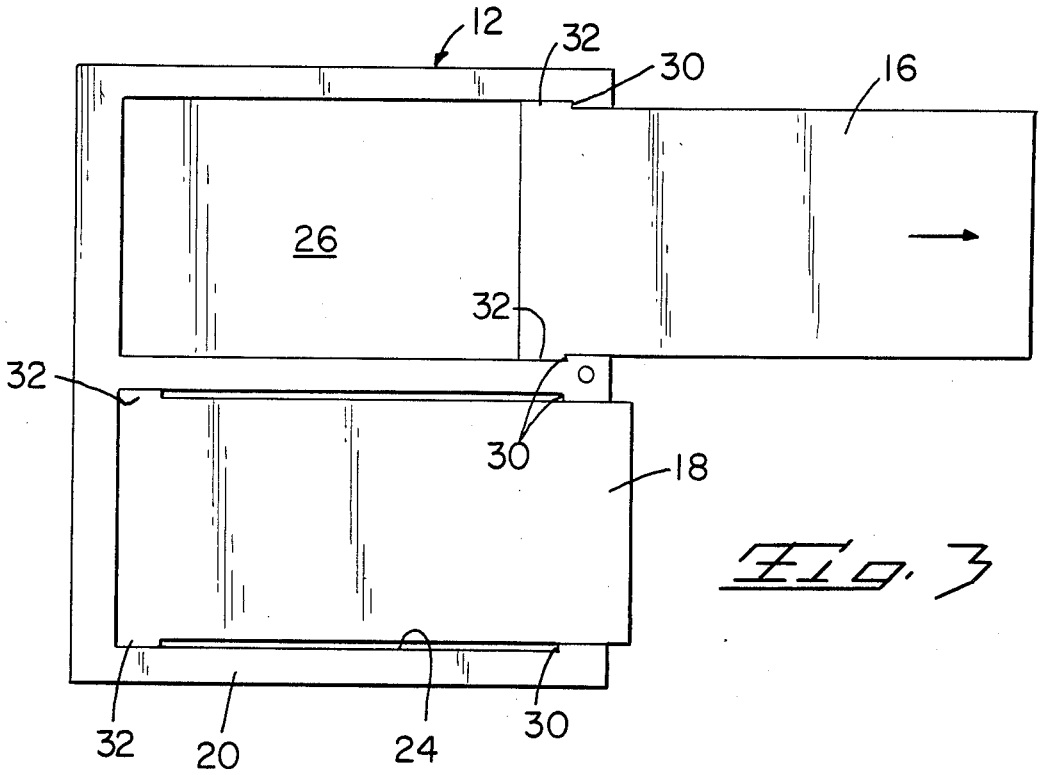

FIG. (4) is a perspective view of FIG. 3 in an assembled condition.

Figure 4:
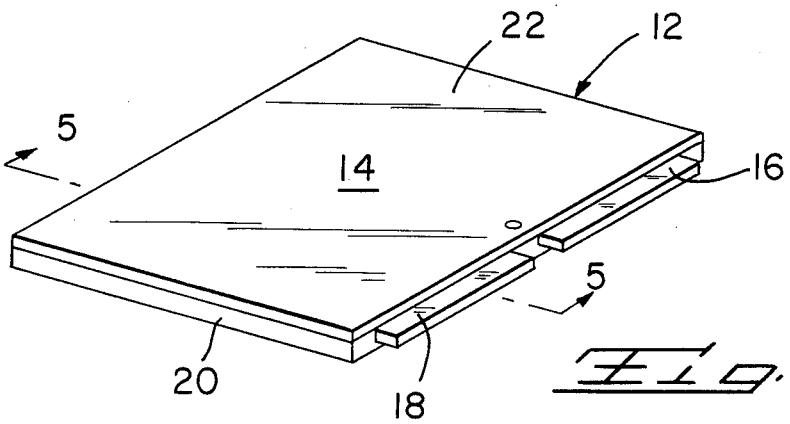

FIG. (5) is a cross-sectional view taken along line 5—5 of FIG. 4.

DETAILED DESCRIPTION OF THE INVENTION

Figure 1:
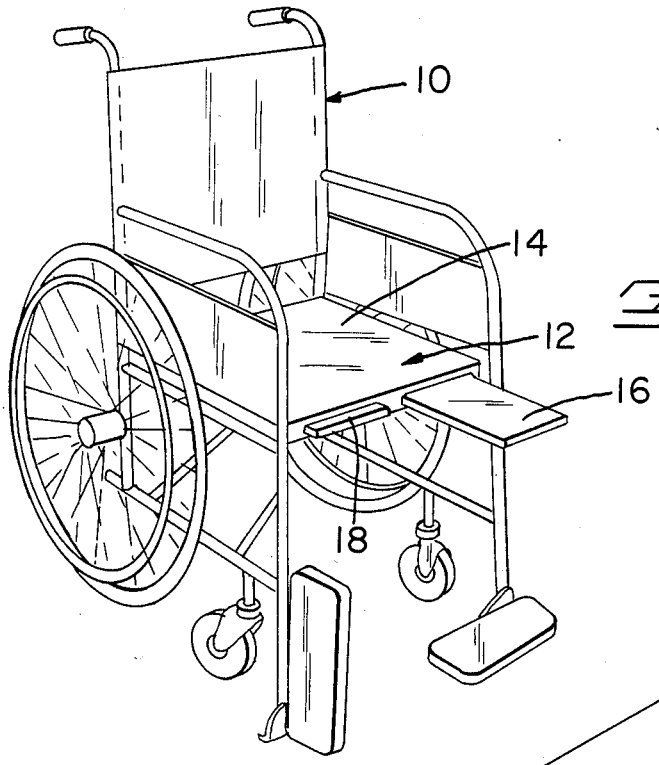
Figure 2:
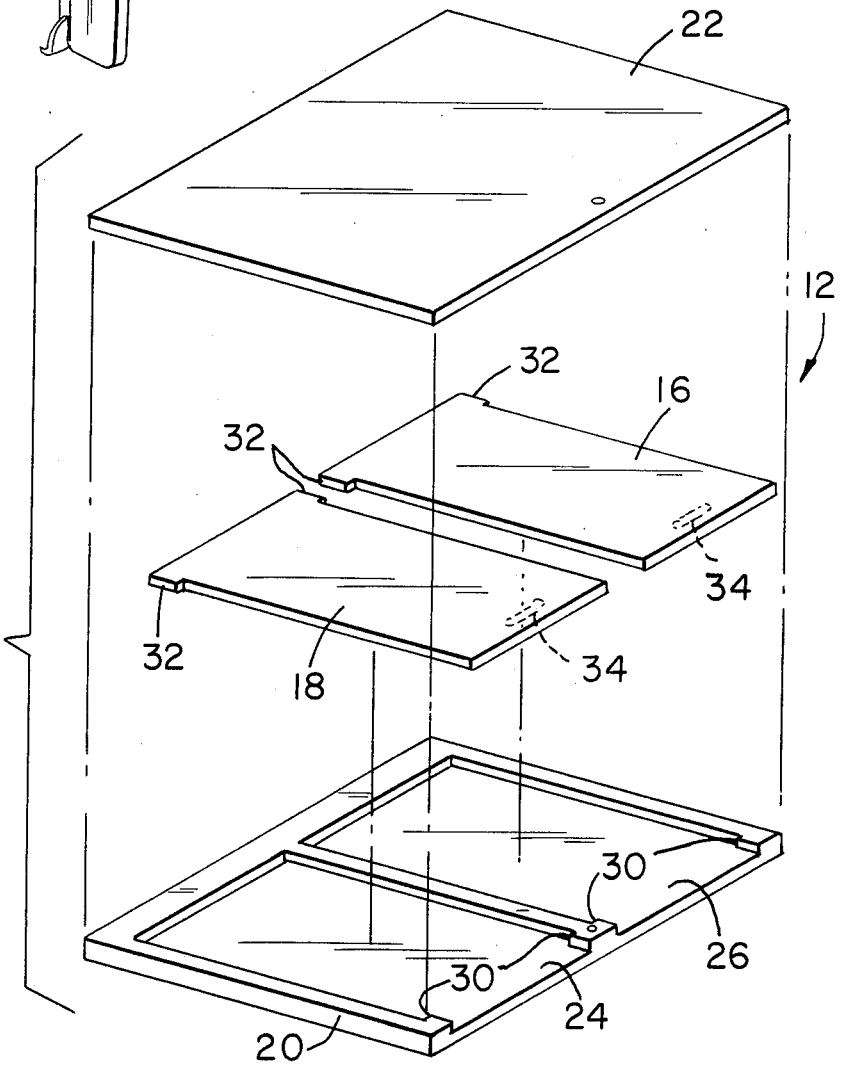
Figure 5:
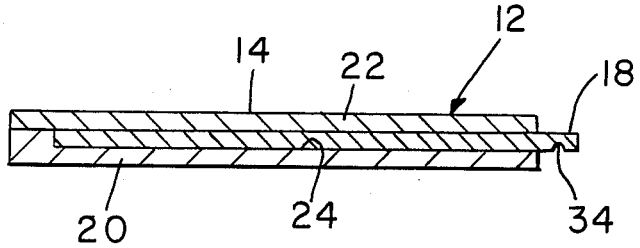

FIG. 1 shows a conventional wheel chair 10 in the seat of which is disposed portable seat 12 which includes seat section 14 and slidable leg-supporting sections 16, 18 that are slidably mounted in seat section 14 enabling them to be slidably moved from a normally nonleg-supporting position within seat section 14 to a leg-supporting position as shown in FIGS. 1 and 3 and slidably returned to their normal nonleg-supporting positions as shown in FIGS. 4 and 5. Leg-supporting sections 16 and 18 enables portable seat 12 to be used with persons who have a right or left leg amputated or both legs amputated.

Portable seat 12 can be placed in any chair or any furniture having a seating section enabling the leg amputee to sit on seat section 10 and the leg amputee can slide either leg-supporting section 16 and 18 to a leg-supporting position on which the leg residual limb or residual limbs can be supported for applying or removing prosthetic devices or insuring proper knee extension and better circulation when the leg amputee is sitting down.

As shown in FIGS. 2–5, portable seat 12 includes a bottom member 20 in which leg-supporting sections 16 and 18 are slidably mounted and a top member 22. Sections 16 and 18 and members 20 and 22 can be made from any suitable material to support the weight of a leg amputee and to support the residual limbs so that sections 16 and 18 can easily slide into and out of seat section 14. Since the seat is portable, the material should be light weight.

Bottom member 20 has cavities 24 and 26 therein in which leg-supporting sections 16 and 18 are respectively disposed. Cavities 24 and 26 are open at their front ends and the side walls adjacent the open front ends have stop surfaces 30 therein. Leg-supporting sections 16 and 18 have projections 32 that move along the respective side walls of cavities 24 and 26 when leg-supporting sections 16 and 18 are respectively slidably moved therealong so that they slide smoothly without wooble with the opposing surfaces of the openings to cavities 24 and 26 assisting in such movement. Projections 32 engage stop surfaces 30 in respective cavities 24 and 26 to limit the outer movement of leg-supporting sections 16 and 18 to their fully extended leg-supporting positions.

When leg-supporting sections 16 and 18 are in their normal nonleg-supporting positions within cavities 24 and 26 as shown in FIGS. 4 and 5, a small front portion of these sections extend outwardly from the front surface of seat section 14 and these small front portions of leg-supporting sections 16 and 18 have grooves 34 in the bottom surfaces serving to enable fingers to engage grooves 34 to slide leg-supporting sections 16 and 18 to their leg-supporting positions. These front portions of leg-supporting sections 16 and 18 extend out from the front surface of seat section 14 a small distance when leg-supporting sections 16 and 18 are in their nonleg-supporting positions within cavities 24 and 26 and do not cause any discomfort when the amputee is sitting on seat section 14.

Top member 22 is secured onto bottom member 20 by adhesive or in any other desirable manner and these members serve as seat section 14 on which the leg amputee is supported while seated thereon. Members 20 and 22 must have sufficient strength to support the leg amputee and to enable leg-supporting sections 16 and 18 to easily slide in and out of seat section 14 without any binding thereof.

To make seat section 14 more comfortable, top member 22 can have foam rubber or polyurethane applied thereto and suitably covered or a pillow of suitable material secured thereto.

In use, portable seat 12 is placed in a seat section of a chair such as wheel chair 10 of FIG. 1. A leg amputee sits on seat section 14 with leg-supporting sections 16 and 18 in their normally nonleg-supporting positions and simply slides either of leg-supporting sections 16 and 18 depending on which leg is amputated to a leg-supporting position whereupon the amputee may then support the residual limb in a restful raised substantially horizontal position. When the amputee desires to rise from the chair, it is a simple operation to slide the leg-supporting section 16 or 18 within seat section 14; thus, with the support removed, the residual limb will drop permitted the amputee to don the prosthesis and rise. Of course, if both legs are amputated, portable seat 12 can be used but assistance will be required.

While a portable seat has been disclosed as being used in all types of chairs or furniture having seating sections, it is to be understood that since seat 12 is portable and made of light weight material, it may be carried or transported and utilized in any place to provide the same purpose as described in connection with a chair.

I claim:

1. A portable seat for a leg amputee that may be positioned on any support such as a chair to provide a support for the leg amputee and the residual limb, comprising:

a seat section on which the amputee can sit; and a leg supporting section slidably positioned in said seat section so as to be within said seat section in a nonleg-supporting position and to be slidable from within said seat section to a leg-supporting position in a substantially horizontal position to support the residual limb of the amputee.

2. A portable seat as set forth in claim 1, wherein said seat section comprises a bottom member having a cavity therein in which said leg-support section is slidably disposed and a top member secured onto said bottom member, said cavity being open at a front end of said bottom member so that a front portion of said leg-supporting section extends outwardly therefrom when said leg-supporting section is in said nonleg-supporting position.

3. A portable seat as set forth in claim 2, wherein opposing side walls of said cavity adjacent the open front end thereof are provided with stop surfaces and said leg-supporting section is provided with projections that engage said stop surfaces to limit the outward movement of the leg-supporting section.

4. A portable seat as set forth in claim 2, wherein the front portion of said leg-supporting section includes a groove for engagement by fingers to slide said leg-supporting section to the leg-supporting position.

5. A portable seat as set forth in claim 1, wherein said seat section comprises a bottom member having cavities therein in which respective leg-supporting sections are slidably disposed and a top member secured onto said bottom member, said cavities being open at a front end of said bottom member so that a front portion of each of said leg supporting sections extend outwardly therefrom when said leg-supporting sections are in their nonleg-supporting positions.

6. A portable seat as set forth in claim 5, wherein the front portions of said leg-supporting sections include a groove for engagement by fingers to slide the leg-supporting sections to their leg-supporting positions.

7. A portable seat as set forth in claim 5, wherein said cavities and said leg-supporting sections include stop means to limit the outward movement of the leg-supporting sections.

8. A portable seat for use by a leg amputee and is positionable on a support such as a wheelchair, chair or the like for supporting the leg amputee and the residual limb, comprising:

seat section means on which the amputee can sit;

leg-supporting section means slidably positioned in said seat section means so as to be within in said seat section means in a nonleg-supporting position and to be slidable from within said seat section means to a leg-supporting position in a substantially horizontal position to support the residual limb of the amputee; and stop means provided by said seat section means and said leg-supporting section means to limit the outward movement of said leg-supporting section means.

9. A portable seat as claimed in claim 8, wherein the front portion of said leg-supporting section means include means for engagement by fingers to slide the leg-supporting section means to the leg-supporting position.

* * * * *

UNITED STATES PATENT AND TRADEMARK OFFICE

Certificate

Patent No. 4,572,577 Patented February 25, 1986

On petition requesting issuance of a certificate for correction of inventorship pursuant to 35 USC 256, it has been found that the above-identified patent, through error and without any deceptive intent, improperly sets forth the inventorship. Accordingly, it is hereby certified that the correct inventorship of this patent is Robert E. Teufel, John H. Zarfoss and Richard H. Bishop.

Signed and Sealed this 2nd Day of September, 1986.

BRADLEY R. GARRIS,
*Office of the Deputy Assistant Commissioner for Patents.*